US006270427B1

(12) United States Patent
Derbin et al.

(10) Patent No.: US 6,270,427 B1
(45) Date of Patent: Aug. 7, 2001

(54) GOLF BALL WITH NICKEL-TITANIUM WOUND CORE

(76) Inventors: J. Todd Derbin, 312 Ramona St., Palo Alto, CA (US) 94301; David A. Ferrera, 848 38th Ave., San Francisco, CA (US) 94121; James W. Paul, 2512 Via Sanchez, Palos Verdes Estates, CA (US) 90274

( * ) Notice: Subject to any disclaimer, the term of this patent is extended or adjusted under 35 U.S.C. 154(b) by 0 days.

(21) Appl. No.: 09/190,897

(22) Filed: Nov. 12, 1998

(51) Int. Cl.[7] ..... A63B 37/06
(52) U.S. Cl. ..... 473/361; 473/360; 473/365
(58) Field of Search ..... 473/354, 360–365

(56) References Cited

U.S. PATENT DOCUMENTS 5,713,801 2/1998 Aoyama .

*Primary Examiner*—Lee Young
*Assistant Examiner*—Rick Kiltae Chang
(74) *Attorney, Agent, or Firm*—Fulwider Patton Lee & Utecht, LLP

(57) ABSTRACT

A superelastic strand used for windings in a golf ball or as strings for a racquet of the type used for racquet sports. The strand is made with at least one fiber of a superelastic material which may be wound into a cable incorporating other fibers of polymeric or superelastic materials. The superelastic material used in the strand can be a nickel-titanium alloy which is heat treated to provide superelastic qualities.

4 Claims, 1 Drawing Sheet

GOLF BALL WITH NICKEL-TITANIUM WOUND CORE

BACKGROUND OF THE INVENTION

1. Field of the Invention

This invention relates to the design of golf balls and other sporting equipment. More particularly, the invention relates to a nickel-titanium fiber for use in the internal structural design of golf balls employing combinations of wound fibers, including a layer of nickel-titanium alloy fiber windings, and plastic layers inside the exterior cover of the golf ball, and for the construction of strings for use in sports racquets.

2. Description of the Related Art

From its beginnings, golf has been influenced by the availability of balls which represent a continuing effort to provide a combination of characteristics aimed at a specific type of golfer. From the earliest constructions available, a conflict has arisen in which the characteristics of a ball which behaves in a way highly desirable for partial shots and putting is different from the characteristics desired by most golfers from a ball used for driving and full iron shots. Specifically, it has been generally believed that a ball which has a soft feel, which can be produced by a lower compression ball, has a desirable characteristic for providing feedback to the golfer for the "touch" shots around the green. A secondary characteristic which is highly desirable for partial and full short iron shots is that a good deal of back spin may be induced into the ball by the descending blow generally used for such shots. The more highly skilled the golfer, the more desirable these characteristics for the short game become. Thus, the more accomplished golfer, one with a lower handicap and the greater skill and ability to utilize the spin of the golf ball to his advantage, wishes to have a ball which can provide a great deal of backspin when hit with the descending blow of a wedge shot around the green. Similarly, the more accomplished golfer is likely to play on very fast greens and the greens which are found on the professional tours are famed for their extreme speed. Under such circumstances, it is highly desirable that the ball provide a soft feel when hit with a putter. As harder balls have become used by handicappers at a somewhat lower skill level than the professionals, the use of putters with inserts has increased as has the availability of some insert wedge designs which allow the production of more spin from a harder ball. There is presently a great deal of interest in providing clubs which make up for any limitation from the ball on the ability to induce spin, especially if it is with the use of a relatively hard ball. The harder ball, however, does have many advantages for the mid-handicapper, and these benefits have accelerated the desire to provide softer feel by means of the face of the club, rather than to attempt to obtain a soft feel from the ball itself. Two factors which have combined to provide a harder ball are an increased desire for distance from the ball with relatively low club head speeds and a desire for increased durability compared to the balata covered balls used by the tour players in the middle of the twentieth century.

The balls which have been used by tour players in the past and are still much favored by the more accomplished golfer are often those of a wound elastic thread construction around a liquid center, with a balata or synthetic or natural rubber surface. Such balls have a very soft feel and the soft cover, and can induce a great deal of spin which can be effectively used by the accomplished golfer. One reason for a trend towards harder golf balls is that they have a more durable cover made of Surlyn or any of a variety of other relatively durable polymers so that the ball can last many times longer than a balata covered round ball. Another benefit to the solid core, Surlyn covered ball is that it is more resistant to damage of all kinds including the possibility of rupture of the internal windings or any other deformation due to hitting a tree or the like, which would make the ball unplayable.

As the technology of golf balls has improved, there now are some balls which have no less than four layers designed for the purpose of influencing the combination of softness, spin and distance available from the ball to a specifically targeted level of player. Moreover, material such as titanium, magnesium and the like have been introduced into the polymers used within the ball in order to improve binding characteristics and energy transfer. However, such construction using these materials involves a very highly divided state of the powder, even to the molecular level, and thus does not represent a layer of metallic material per se. While there have been suggestions of the use of a variety of materials in windings, and many materials, including rubber, polyamide, graphite and the like have actually been used, these materials have not provided all of the desirable benefits desired, but represent improvements in the design of a golf ball for a specific type of golfer.

In one prior art golf ball, a golf ball is wound with a fiber of high tensile strength fibers of at least 250,000 psi strength to create a high hoop stress layer. However, such a construction creates a relatively hard feeling layer to the ball. Accordingly, there is a continued desire to find constructions which are capable of providing new and important characteristics which may be used in the development of a golf ball directed towards specific groups of golfers. The present invention is directed to a specific application of new technology providing those benefits.

A second area of constant need for improvement is in strings for use in the racquet sports. Many different strand materials have been tried, including animal fibers and artificial fibers such as graphite and nylon. There remains, however, a need for new materials and methods of construction for racquet sports strings that exhibit new and desirable characteristics.

SUMMARY OF THE INVENTION

Briefly and in general terms, the present invention is directed to a new golf ball construction which can be used to provide previously unavailable combinations of characteristics. The invention utilizes a wound layer of newly discovered superelastic material to provide a layer of material within the golf ball which may be placed in order to provide specifically targeted combinations of spin, inertia, resilience, softness and ball flight characteristics. While a number of superelastic materials may be suitable for the purposes of the invention, one particular form of superelastic nickel titanium alloy shows great promise in fully exploiting the benefits of the invention.

According to one aspect of the invention, a fine nickel titanium superelastic wire is wound in at least one layer of the golf ball to provide specific rotational moment of inertia representing a desired ability to sustain rotational speed after being struck with a golf club. More specifically, a golf ball may be constructed which includes at least one layer of a soft outer cover design to provide a surface into which dimples may be formed and which is suitable for impact by a golf club. At least one additional inner core material may be formed of a solid polymer material or the like to provide the central resilient portion of the golf ball. Around the core material is then wound a layer of the superelastic and resilient wire made of nickel titanium alloy in order to contain the inner core and provide a layer at a predetermined position to produce the desired rotational moment of inertia in combination with compression and resilience.

In a presently preferred embodiment of the invention, an inner liquid or solid core is surrounded by one or more progressive layers of wound superelastic wire and resilient rubber windings of the type that have been used for some time in the construction of golf balls to produce the desired characteristics of the softness, spin rate and stability for the ball. For example, it is possible to control the rotational moment of inertia of the ball in order to increase or decrease the amount of spin that is likely to be induced from a club striking the ball, while at the same time maintain softness or launch angle from a given loft of golf club. Moreover, it is possible to manufacture a ball with multiple layers of the superelastic resilient metal wire in order to alter and customize the final characteristics of a ball manufacture according to the invention.

In another aspect of the use of the material discovered for use in the golf ball of the invention, it has been discovered that a wound multiple strand of the nickel-titanium wire can be used for stringing racquets. More particularly, the nickel-titanium strand in its superelastic form has important benefits compared to both previously used wires and artificial fibers and can also be configured to create a stranded cable that can be made up of a plurality of materials that can provide hitherto unavailable benefits.

From the above it may be seen that the present invention represents a new means of further enhancing the ability of a designer of sports equipment to produce desirable characteristics in a golf ball, while avoiding the use of new and exotic methods of manufacture. The existing winding machines used to wind resilient material may be adapted to produce windings in the ball made of the nickel-titanium wire strands. These and other benefits to the invention will be readily apparent by the accompanying detailed description of the drawings which illustrate by way of example the benefits of the invention.

DETAILED DESCRIPTION OF THE PREFERRED EMBODIMENTS

Figure 1:
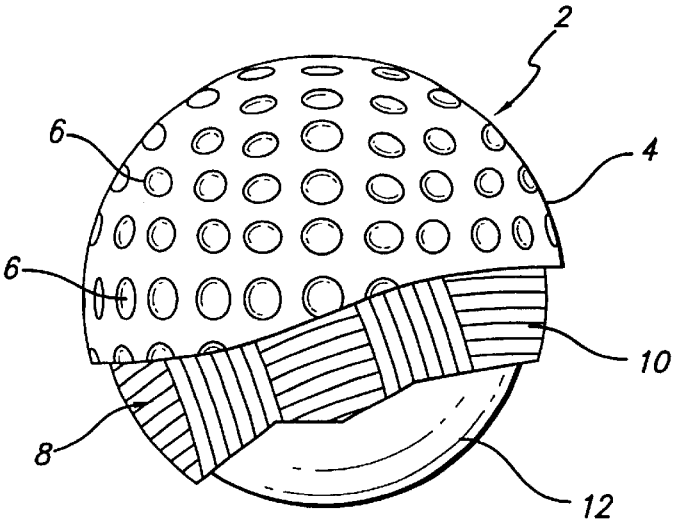
FIG. 1 is a sectional cut-away view of a solid inner core golf ball in accordance with the current invention.
Figure 2:
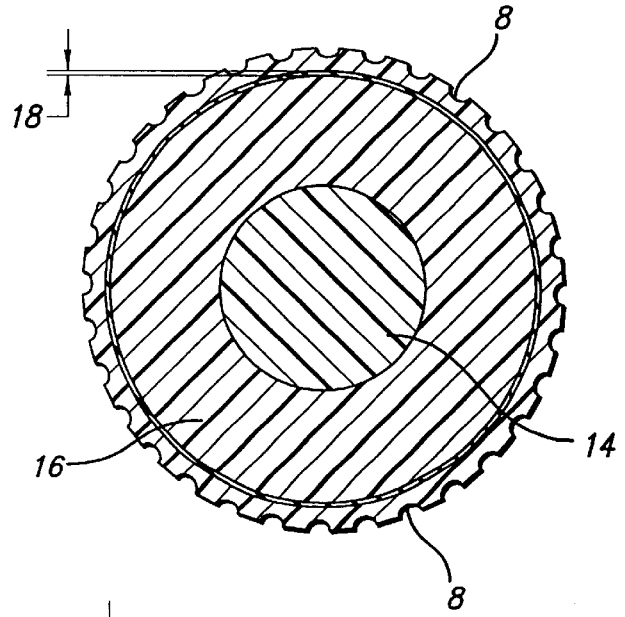
FIG. 2 illustrates a cross section of a wound golf ball according to the present invention.

Referring to FIG. 1, a golf ball 2 constructed according to the invention has a resilient outer cover 4 in which dimples 6 are typically formed to improve the aerodynamic characteristics of the golf ball. Within the outer layer is a wound layer 8 of resilient wire 10, the material and thickness of which is varied in order to produce the desired characteristics of the golf ball. In practice, it is believed that one material which may be advantageously used is superelastic nickel titanium wire which is then wound about a solid inner core 12 prior to molding of the outer cover over the wound layer of wire. The wound layer is preferably in contact with the inner core and designed to provide a combination of resilience and inertia characteristics which were not previously available from other materials previously contemplated for such purposes. Referring to FIG. 2, a second preferred embodiment of the invention is illustrated in cross section in which the wound layer 8 is formed over a two-stage core 14, 16 consisting of successive spheres of material with hardness chosen to provide specific performance characteristics. As with the first preferred embodiment, the wound wire core can be positioned as a first layer 8 of a thickness 18 within the outer cover for the purposes of providing the maximum rotational inertia of the golf ball.

A material believed to be particularly advantageous for the construction of the invention is the alloy of nickel-titanium known as Nitinol®. This material can be heat treated to be superelastic and highly resilient compared to other metal alloys and displays many improved characteristics compared to other ball construction materials. For example, Nitinol® can be heat treated to have a Young's modulus in its austenitic phase of about 12,000 ksi and in its martensitic phase to have a Young's modulus of between 4 and 6,000 ksi. Similarly, its yield strength can be approximately 28–200 ksi in the austenitic phase and 10–20 ksi in the martensitic phase. These characteristics provide benefits not present in fibers appropriate for high hoop strength constructions, and allow the construction of a softer feeling ball with different inertial and flight characteristics from prior art constructions.

Figure 3:
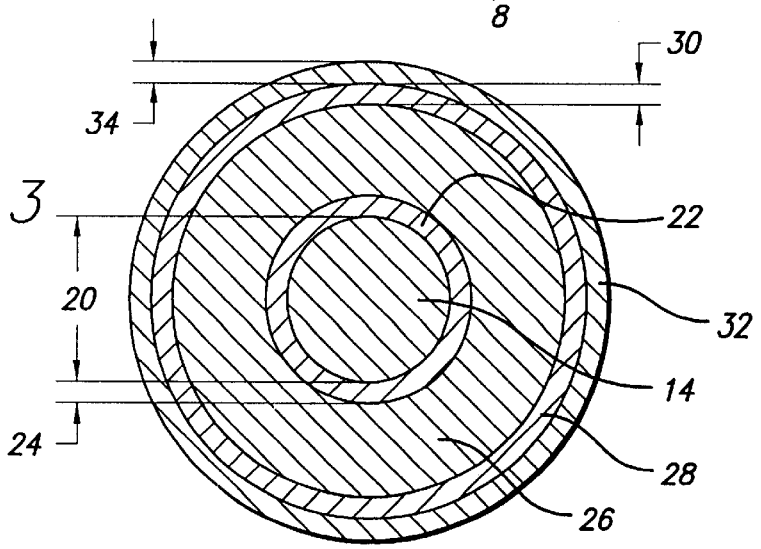
FIG. 3 illustrates a cross section of a multiple layer wound golf ball according to the invention.

Referring now to FIG. 3, a third preferred embodiment is illustrated in which a multi-layer golf ball is constructed according to the invention. In this construction, an inner core 14 or diameter 20 is surrounded by a first wound layer of nickel titanium wire 22 or thickness 24 which is then in turn surrounded by a second solid layer 26 and finally an additional wound layer 28 or thickness 30 of either nickel titanium or other materials. An outer layer 32 or cover material such as Surlyn or thickness 34 is provided. Such construction provides the benefits of containment of successive layers within the wound layer of superelastic nickel titanium material to provide performance characteristics hereto unavailable in wound or multi-layer solid golf balls.

A further benefit of the use of the nickel-titanium material is in stranded strings for racquets to be used in the racquet sports. More particularly, the racquet strings can be of a stranded cable containing one or more nickel-titanium strands combined with other strand materials to provide a hitherto unavailable combination of characteristics. As discussed above, the nickel-titanium wire can be heat treated to provide beneficial characteristics, and the cable can be made of a plurality of strands of various other materials to create a composite string to be used for stringing racquets. In that way, strings that are highly resilient and superelastic can also be relatively soft and flexible and thus not cut the racquet or ball during use.

From the above, it would be appreciated that the present invention provides important benefits compared to previously described and disclosed golf ball and racquet stringing constructions. While several particular forms of the invention have been illustrated and described above, it will also be apparent that various modifications can be made without departing from the spirit and scope of this invention. Accordingly, it is not intended that the invention be limited except as by the appended claims.

We claim:

1. A golf ball comprising:

a substantially spherical inner core;

a wound layer of one or more strands of a stranded cable containing at least one strand of a superelastic nickel titanium alloy wound about said core, said superelastic nickel titanium alloy having a Young's modulus of between 4 and 6,000 ksi; and a molded layer of a polymeric material surrounding said wound layer.

2. The golf ball of claim 1, wherein said superelastic nickel titanium alloy is an alloy comprising at least 45% nickel, at least 45% titanium and heat treated to a temperature of approximately 500° C. from 1 second to less than 60 minutes.

3. A golf ball comprising:

a substantially spherical inner core;

a wound layer of one or more strands of a stranded cable containing at least one strand of a nickel titanium alloy wound about said core; and a molded layer of a polymeric material surrounding said wound layer.

4. The golf ball of claim 1 wherein said nickel titanium alloy is an alloy comprising at least 45% nickel, at least 45% titanium and heat treated to a temperature of approximately 500° C. from 1 second to less than 60 minutes.

* * * * *